US006085998A

United States Patent [19]

Yokoyama

[11] Patent Number: 6,085,998

[45] Date of Patent: Jul. 11, 2000

[54] DISMOUNTABLE HOT AIR NOZZLE

[75] Inventor: Tetsuo Yokoyama, Osaka, Japan

[73] Assignee: Hakko Corporation, Osaka, Japan

[21] Appl. No.: 09/245,997

[22] Filed: Feb. 5, 1999

[30] Foreign Application Priority Data

Nov. 17, 1998 [JP] Japan ..... 10-326575

[51] Int. Cl.[7] ..... B05B 1/00

[52] U.S. Cl. ..... 239/600; 285/307; 403/348

[58] Field of Search ..... 239/600, 128, 239/133, 135; 285/305, 307, 319, 321; 403/348

[56] References Cited

U.S. PATENT DOCUMENTS

| | | | |
|---|---|---|---|
| 967,395 | 8/1910 | Langhaar | 285/305 |
| 1,646,456 | 10/1927 | Noreen et al. | 239/600 |
| 2,455,544 | 12/1948 | Yonkers | 285/321 |
| 3,695,645 | 10/1972 | Mommsen | 285/321 |
| 3,695,646 | 10/1972 | Mommsen | 285/321 |
| 4,347,025 | 8/1982 | Long | 239/600 |
| 4,640,534 | 2/1987 | Hoskins et al. | 285/305 |
| 5,447,342 | 9/1995 | Mazhar | 285/307 |
| 5,657,525 | 8/1997 | Hoyt, III et al. | 403/348 |

FOREIGN PATENT DOCUMENTS

| | | | |
|---|---|---|---|
| 1247087 | 8/1967 | Germany | 285/321 |
| 2437025 | 2/1976 | Germany | 239/600 |
| 3014066 | 10/1981 | Germany | 236/600 |
| 3632005 | 4/1988 | Germany | 239/600 |

*Primary Examiner*—Andres Kashnikow
*Assistant Examiner*—Christopher S. Kim
*Attorney, Agent, or Firm*—Vedder Price Kaufman & Kammholz

[57] ABSTRACT

A dismountable hot air nozzle comprising a mounting adapter (2) to be secured to a nozzle pipe (92), a generally annular adapter spring (59) cut in one position and having engaging bosses (59*a*) adapted to project from the inner circumferential surface of the mounting adapter when assembled, a stopper pin (58) projecting out of the inner circumferential surface of the mounting adapter in a position adjacent to the engaging boss when assembled, and a nozzle holder (3) carrying a nozzle (8) at its lower end and formed as a cylindrical member (6) adapted to fit into the mounting adapter at its upper end, the upper end of the cylindrical member being formed with recesses (61) engageable with the stopper pin (58) at their circumferentially lateral edges and the cylindrical member being further formed with slits (62) engageable with the engaging bosses (59*a*) as the engageable circumferentially lateral edge of recess (61) is engaged by the stopper pin (58).

3 Claims, 6 Drawing Sheets

DISMOUNTABLE HOT AIR NOZZLE

BACKGROUND OF THE INVENTION

1. Field of the Invention

The present invention relates to a dismountable hot air nozzle for a hot air jet heater which is mainly used in the repairing of surface-mounted IC devices on a printed circuit board.

2. Description of the Related Art

The conventional hot air nozzle comprises, as illustrated in FIG. 6, a nozzle member A and a cylindrical member B carrying said nozzle member A at its forward end and having a clamp C at its base end, said cylindrical member being fitted over a nozzle pipe D and secured in position by tightening the screw of said clamp C.

As to the method for connecting the nozzle to the nozzle pipe, there also known the method which comprises fitting the cylindrical member over the nozzle pipe and securing them together with a setscrew and the method which comprises cutting a female thread on the inner wall of the cylindrical member, screwing the male thread at the forward end of the nozzle pipe into said female thread and tightening them together firmly with a spanner.

However, in any of those arrangements, a tool such as a screwdriver or a spanner is required for connecting the nozzle (cylindrical member) to the nozzle pipe. Moreover, this connection and disconnection requiring both hands are both time-consuming and labor-consuming.

Having been developed to overcome the above disadvantages, the present invention has for its primary object to provide a dismountable hot air nozzle which can be mounted or dismounted for replacement by one hand with one-touch ease without using a screwdriver or the like tool and jig. Another object is to provide such a dismountable nozzle consisting of a fewer number Of parts at low cost.

SUMMARY OF THE INVENTION

The dismountable hot air nozzle of the invention is applicable to a hot air jet heater for use in the dismounting of surface-mounted IC devices and other purposes, which comprises a downwardly open cylindrical mounting adapter to be attached to a hot air delivery pipe of said heater, a generally annular adapter spring capable of undergoing elastic deformation in a radial direction and having engaging bosses adapted to project from the inner circumferential wall of said mounting adapter when assembled, a stopper pin disposed adjacently of one of said engaging bosses and projecting radially inwardly of the inner circumferential surface of said mounting adapter, and a nozzle holder having nozzle means for the delivery of hot air from said pipe at its lower end and a cylindrical member engageable with the opening of said mounting adapter at its upper end, the top end of said cylindrical member being formed with recesses through which the engaging bosses of said adapter spring and said stopper pin may pass when the cylindrical member is inserted into said mounting adapter, each of said recesses being formed with an engaging means engageable with said stopper pin at its lateral end in such a manner that when said cylindrical member is inserted into said mounting adapter and rotated in a circumferential direction, said engaging means is engaged by said stopper pin and said engaging bosses are fitted into slits formed adjacent to the recesses of said cylindrical member.

Preferably, the dismountable hot air nozzle of the invention is further characterized in that said mounting adapter consists of an adapter holder to be secured to said hot air delivery pipe and an adapter cover disposed at a lower part of said adapter holder, said adapter cover is provided with said adapter spring and stopper pin, said adapter spring is formed with engaging bosses as formed by bending it radially inward in a generally semicircular form in a plurality of circumferential positions, and said adapter cover is peripherally formed with a spring groove in which said adapter spring is disposed, said spring groove being formed with engaging holes passing through the circumferential wall of said adapter cover in positions corresponding to the engaging bosses of said adapter spring.

The more preferred dismountable hot air nozzle of the invention is such that said stopper pin is disposed above one circumferentially lateral edge of one of said engaging holes of said adapter cover and said engaging means is formed by cutting out the cylindrical member at the other circumferentially lateral edge of the recess of said cylindrical member in such a manner that when said engaging means is engaged by said stopper pin, one circumferentially lateral edge of each engaging boss is abutted against one circumferentially lateral edge of the corresponding slit.

In the dismountable hot air nozzle of the invention, the nozzle can be changed with great ease and rapidly in one-touch operation by one hand without using a screwdriver or the like tool. Moreover, the whole construction is simple and consists of a reduced number of parts, thus contributing to cost reduction. In particular, the dismountable hot air nozzle of the invention can be easily adapted to repair work on various surface-mounted devices simply by providing a plurality of nozzle holders varying in the nozzle position and shape using a common mounting adapter.

BRIEF DESCRIPTION OF THE SEVERAL VIEWS OF THE DRAWING

FIG. 3(*b*) is a sectional view taken along line A—A of FIG. 3(*a*).

FIG. 4(*b*) is a sectional view taken along the line B—B of FIG. 4(*a*).

FIG. 5(*b*) is a sectional view taken along the line C—C of FIG. 5(*a*).

DETAILED DESCRIPTION OF THE PREFERRED EMBODIMENTS

The dismountable hot air nozzle of the invention is now described in further detail.

Figure 1:
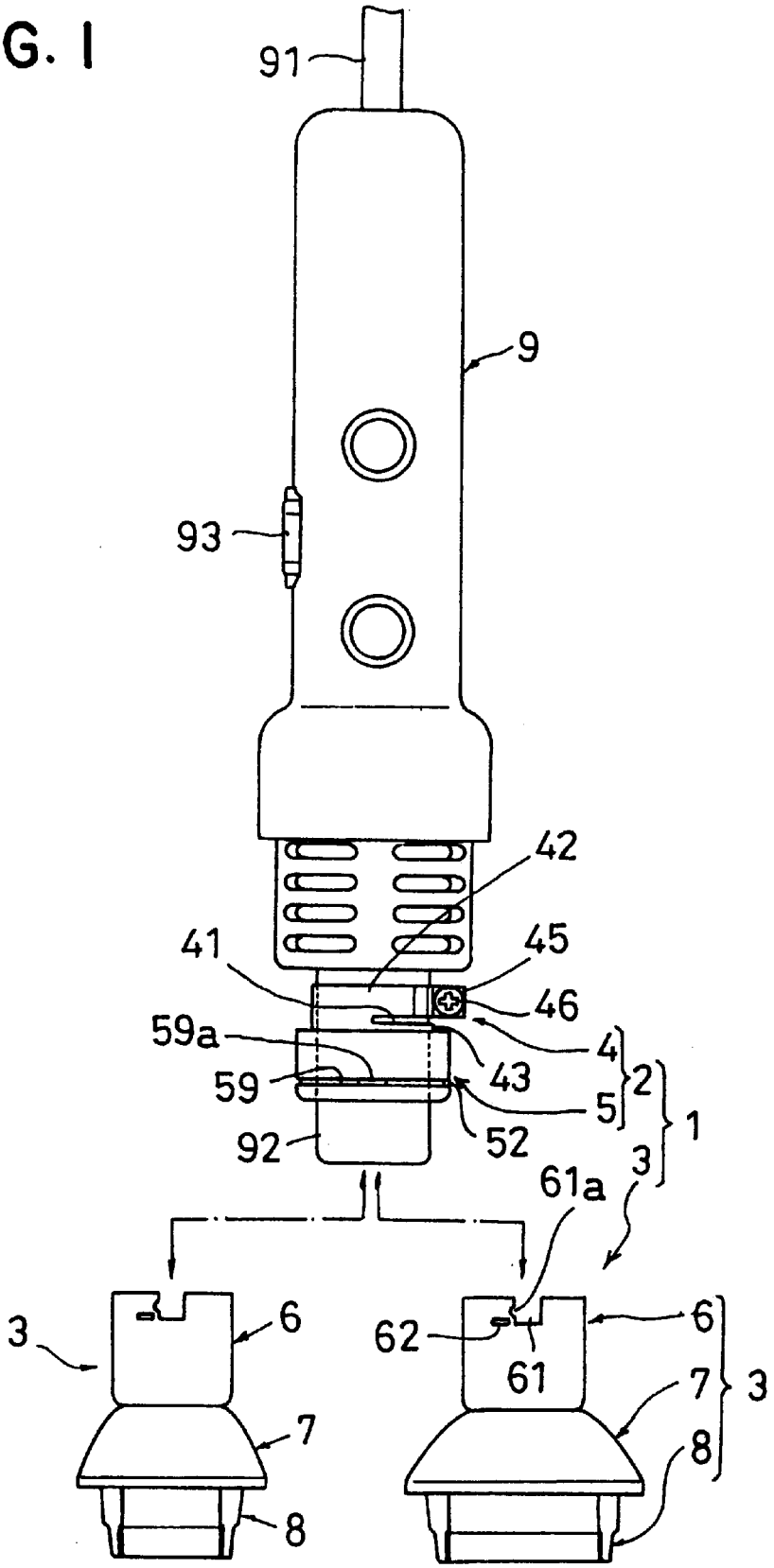
FIG. 1 is a front view of the iron segment of a hot air jet heater to which a dismountable hot air nozzle embodying this invention has been applied.
Figure 2:
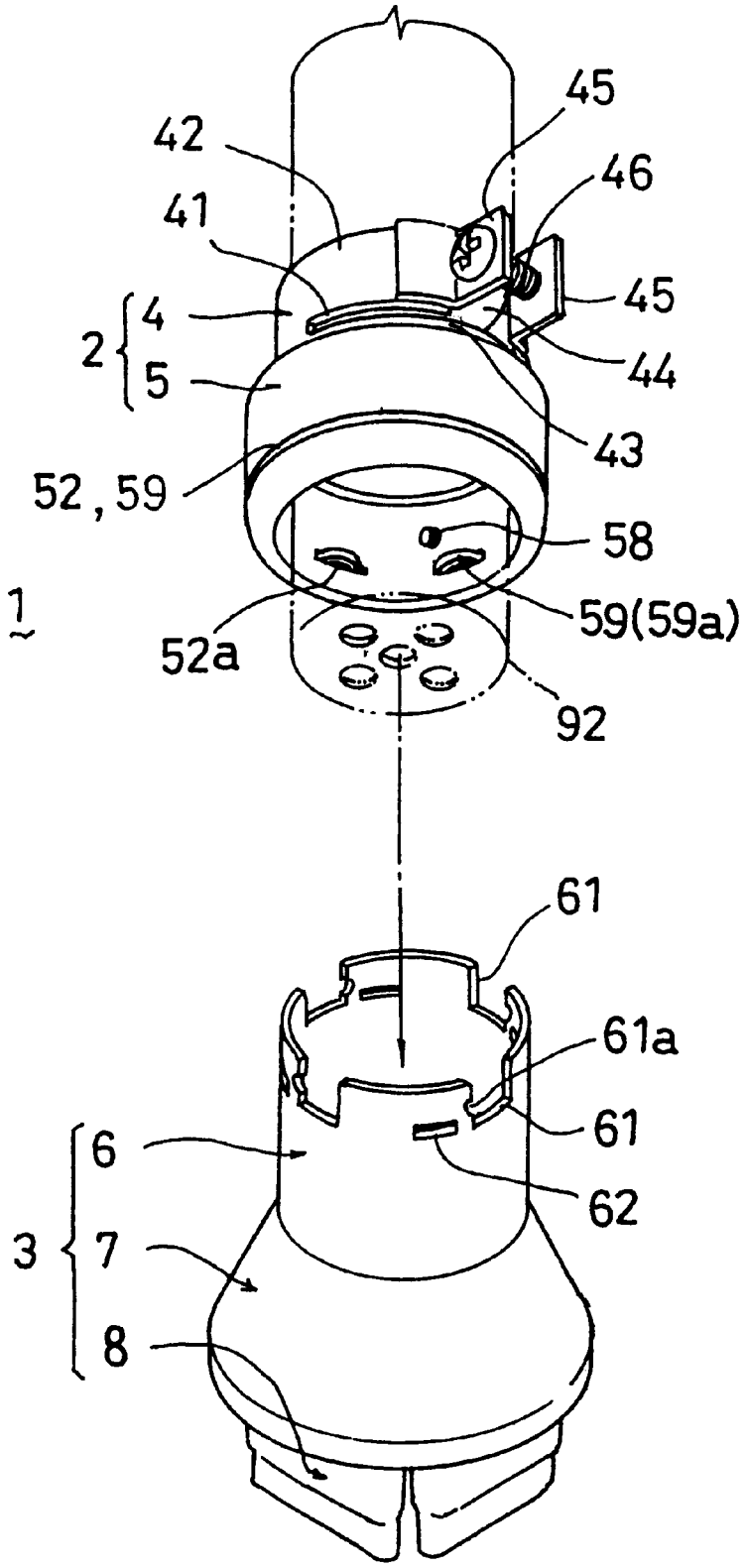
FIG. 2 is a disassembled perspective view of the dismountable nozzle shown in FIG. 1.

FIG. 1 is a front view showing an iron segment 9 of a hot air jet heater (repair station) to which a dismountable nozzle 1 embodying the invention has been applied and FIG. 2 is a disassembled perspective view of the dismountable nozzle.

The base (upper) portion of the iron segment 9 is connected to a station (not shown) by an air pipe and a power cord 91. Thus, the air from the station is fed to the iron segment 9 via said air pipe 91 and delivered from a forward end of a nozzle pipe 92. Since a heater is disposed within the nozzle pipe 92, the air from the station is heated here and delivered as hot air. The volume and temperature of delivered air can be adjusted in the station (or the iron segment), for example within the range of up to 23 1/min. and 100~420° C.

The dismountable nozzle 1 of the invention to be mounted on the nozzle pipe 92 comprises a mounting adapter 2 which is to be secured to the nozzle pipe 92 and a nozzle holder 3 to be dismountably attached to said mounting adapter 2. The material constituting the dismountable nozzle 1 is not particularly restricted but may for example be stainless steel, brass, or iron.

The mounting adapter 2 comprises an adapter holder 4 to be secured rigidly to the nozzle pipe 92 and an adapter cover 5 which is disposed at the lower end of said adapter holder and on which the nozzle holder 3 is mounted.

The adapter holder 4 is a cylindrical member having an inside diameter corresponding to the outer diameter of the nozzle pipe 92 and has a horizontal incision 41 along the midline in the axial direction thereof in the right-hand half of its circumferential wall as viewed in FIG. 1, whereby the adapter holder 4 is divided into two parts (42, 43), upper and lower.

The upper cylindrical part 42 of the adapter holder 4 is formed with a clamp. Thus, the right-hand side of the upper cylindrical part 42 of the adapter holder 4 is formed with a cutout 44 extending along a vertical axis (FIG. 2), so that the upper cylindrical part 42 is open on the right-hand side. The two lateral edges of this cutout 44 are provided with rectangular clamping members 45, 45 extending at right angles with the axial direction and a clamping screw 46 is bridging those clamping members 45, 45. Therefore, by adjusting this clamping screw 46, the spacing between the two clamping members can be adjusted to alter the diameter of the upper cylindrical part 42.

The adapter cover 5 is fitted onto the lower cylindrical part 43 of the adapter holder 4 and secured rigidly in position, for example by welding.

Figure 3A:
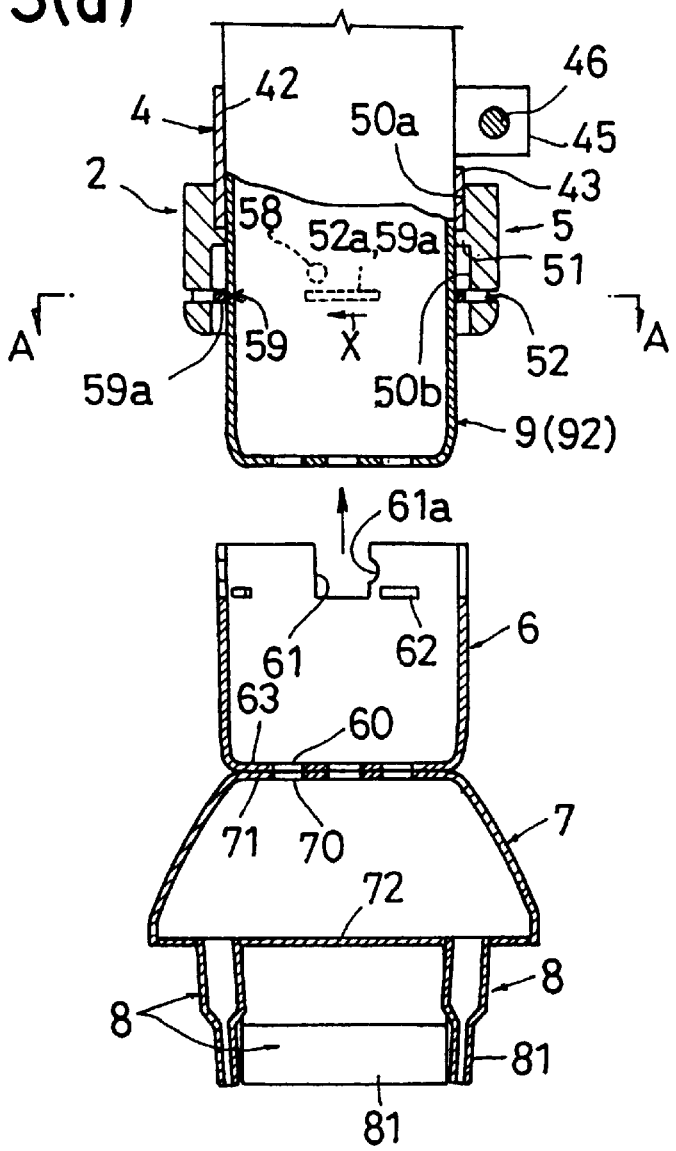
FIG. 3(*a*) is a longitudinal sectional view that shows an assembling status of the dismountable nozzle of FIG. 1 prior to fitting a nozzle holder to a mounting adapter.
Figure 3B:
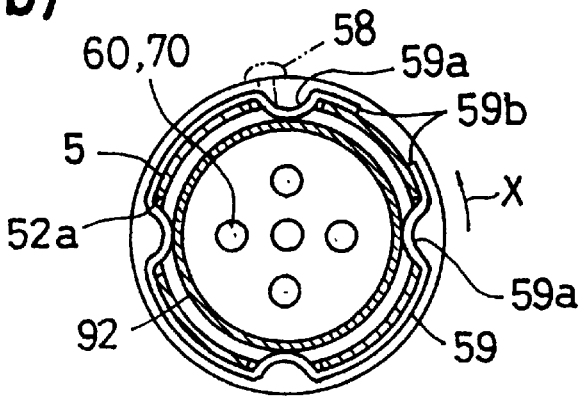

The adapter cover 5 is a cylindrical element having an annular flange 51 which is rectangular in section and projecting radially inward in the center of the cover in the axial direction (FIG. 3(*a*)). It is so arranged that the upper and lower surfaces of said annular flange 51 intersect the inner surfaces 50*a*, 50*b* of the cylinder at right angles.

In the upper bore of the adapter cover 5 which lies above the annular flange 51, the lower cylindrical part 43 of said adapter holder 4 is fitted and locked in position. In this connection, since the upper surface of said annular flange 51 is at right angles with the inner circumferential surface 50*a*, the lower cylindrical part 43 of the adapter holder 4 can be tightly fitted into the upper bore of the adapter cover 5 by abutting the lower end of the lower cylindrical part 43 of the adapter holder 4 positively against the upper face of the annular flange 51 of the adapter cover 5.

The adapter cover 5 is provided with a spring groove 52, which is rectangular in section, in the form of a radially inward recess along the circumference in the outer periphery of the cylinder below said annular flange 51. The bottom wall (radially inward side wall) of this spring groove 52 is formed with a plurality of engaging holes 52*a* piercing the adapter cover 5 at predetermined circumferential pitches (FIG. 2, FIG. 3(*b*)). The number, shape, and position of the engaging holes 52*a* are determined in relation to engaging bosses 59*a* of adapter springs 59 which will be described below but, in the illustrated example, 4 engaging holes 52*a* are provided at circumferential pitches of 90 degrees.

The adapter spring 59 is a generally annular element made from a wire rod rectangular in section and cut in one circumferential position. The adapter spring 59 has 4 engaging bosses 59*a* each formed by bending it radially inward in the view of FIG. 3(*b*) in a generally semicircular configuration at intervals of 90 degrees. Those engaging basses 59*a* are disposed symmetrically with respect to the open ends 59*b*, 59*b*.

To install the adapter spring 59 in the spring groove 52 of the adapter cover 5, the spring 59 is forced to undergo elastic deformation so as to bring its open ends 59*b*, 59*b* further apart from each other. In the fit condition of the adapter spring 59, its engaging bosses 59*a* are disposed within the engaging holes 52*a* of the adapter cover 5 with the forward end of each boss 59*a* projecting out radially from the inner circumferential wall of the adapter cover 5. Since the adapter spring 59 is a generally annular element cut in one position, it can be forced to undergo elastic deformation so as to radially shift the engaging bosses 59*a*.

The adapter cover 5 is provided with a stopper pin 58 projecting radially inward from the circumferential wall thereof in a position adjoining to one of said engaging holes 52*a*. In the illustrated example, the stopper pin 58 is disposed above one end of the engaging hole 52*a*. Thus, in the circumferential wall of the adapter cover 4 adjacent to the engaging hole 52*a* situated behind in the views of FIGS. 1 and 3, the stopper pin 58 is provided above the clockwise edge of the engaging hole 52*a* (the term "clockwise" means the clockwise direction as viewed from the tip of the iron, that is from below; in other words the direction indicated by the arrowmark X in FIGS. 3(*a*) and (*b*)). In this embodiment, the stopper pin 58 is installed by screwing it radially inward until it projects out of the inner circumferential surface 50*b* of the adapter cover 5 through its peripheral wall. Of course, the stopper pin 58 can be installed by pressing it into the circumferential wall of the adapter cover 5 instead of installing it by screw means.

The nozzle holder 3 comprises a cylindrical member 6 to be fitted into said adapter holder 5 and a nozzle means 8 to be connected below said cylindrical member 6.

The cylindrical member 6 is formed as a bottomed cylinder opening at its upper end and the outer diameter of its upper end corresponds to the inner diameter of the under bore of said adapter cover 5 which lies below said annular flange 51. The inner diameter of the cylindrical member 6 and adapter holder 4 corresponds to the outer diameter of the nozzle pipe 92.

The upper end of the cylindrical member 6 is formed with generally rectangular, upwardly open recesses 61 into which the engaging bosses 59*a* of the adapter spring 59 can be inserted. In the illustrated example, 4 recesses 61 are provided at intervals of 90 degrees in correspondence with the engaging bosses 59*a* of the adapter spring 59. At the edge of the recess 61 which lies at the counterclockwise side, the recess 61 is provided with an engaging means 61*a* adapted to engage said stopper pin 58 in the form of a generally semicircular cutout opening in the counterclockwise direction in the vertically central position thereof. Furthermore, the peripheral wall of the cylindrical member 6 is provided with a circumferentially elongated slit 62 adjacent to each recess 61 at the same level as the lower side of the recess 61. This slit 62 is spaced apart slightly from the counterclockwise side of the recess 61. The circumferential length of each slit 62 is slightly smaller than the circumferential length of each recess 61 and engageable with the engaging boss 59*a* of the adapter spring 59.

The lower end of the cylindrical member 6 is adapted to accept a variety of nozzle elements 8 through a coupling member 7. In the illustrated example, the coupling member 7 is a hollow element in the form of a frustum of circular cone which is progressively increasing in diameter and opening in a downward direction and its upper end 71 is rigidly secured to a bottom wall 63 of said cylindrical member 6. On the other hand, a bottom wall 72 is fixed to its downward opening and four nozzle elements 8 extending downward in a square layout are secured rigidly to said bottom wall 72. Each of the nozzle 8 illustrated is a thin, generally rectangular hollow member with its delivery port 81 at the lower end being further constricted to a narrow width. The bottom wall 63 of the cylindrical member 6 and the upper end 71 of the coupling member 7 are provided with suitable openings 60, 70 so that the hot air from the nozzle pipe 92 may be delivered from the lower end of the nozzle element 8 through the coupling member 7. In the illustrated example, the bottom wall 63 of the cylindrical member 6 and the upper end 71 of the coupling member 7 are respectively formed with 5 circular holes 60, 70 in concentric relation.

Meanwhile, the nozzle construction may vary with the size and shape of the surface-mounted device (e.g. IC) to be repaired. Therefore, in accordance with the present invention, nozzle holders 3 consisting of a common cylindrical member 6 and various coupling members 7 and nozzle elements 8 are provided. For example, about 50 different nozzle holders 3 varying in size, shape, number, and position as standard items or about 100 or more different nozzle holders inclusive of order-made items can be provided. In that case, the coupling member 7 is also provided in about 5 different shapes. FIG. 1 shows an example in which the size of nozzle element 8 is varied.

Figure 4A:
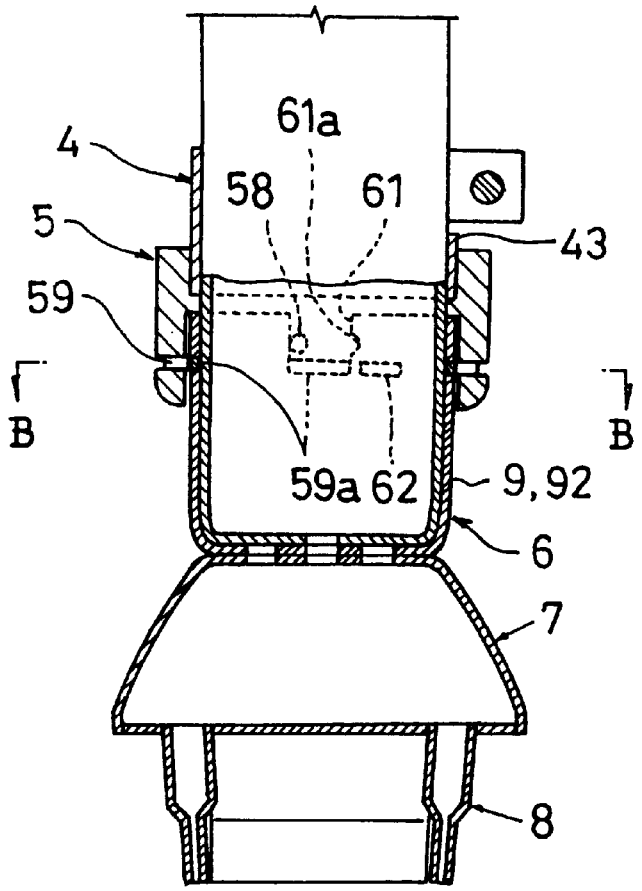
FIG. 4(*a*) is a longitudinal sectional view that shows an assembling status of the dismountable nozzle of FIG. 1, in which the nozzle holder has just been fitted to the nozzle adapter.
Figure 4B:
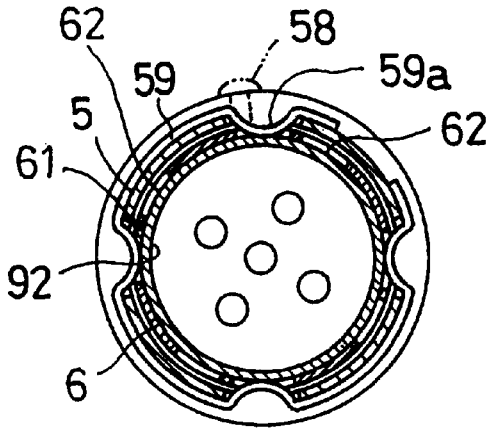
Figure 5A:
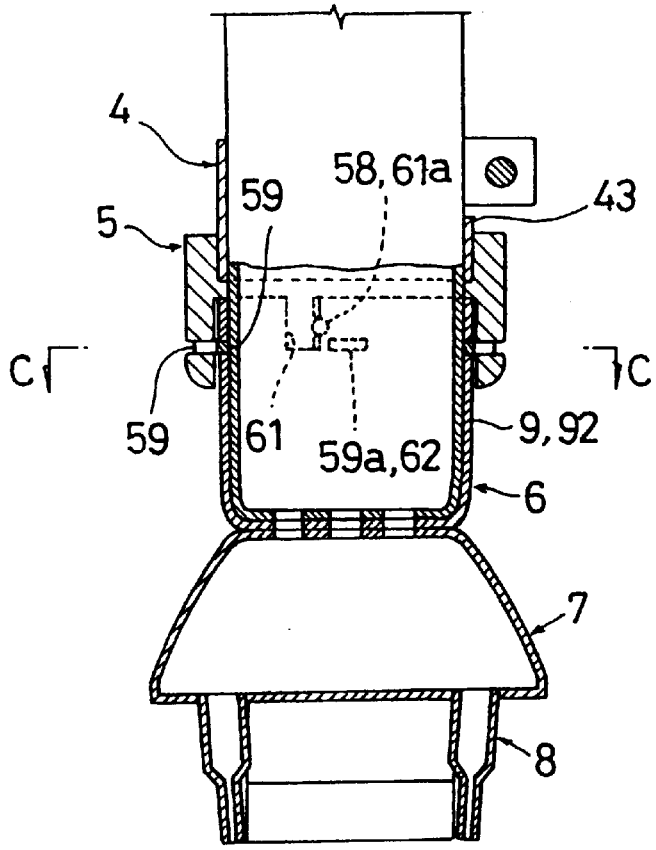
FIG. 5(*a*) is a longitudinal sectional view that shows an assembling status of the dismountable nozzle of FIG. 1 in which, after fitting of the nozzle holder to the mounting adapter, the nozzle holder has been rotated clockwise with respect to the mounting adapter to bring the mounting adapter and nozzle holder into engagement.
Figure 5B:
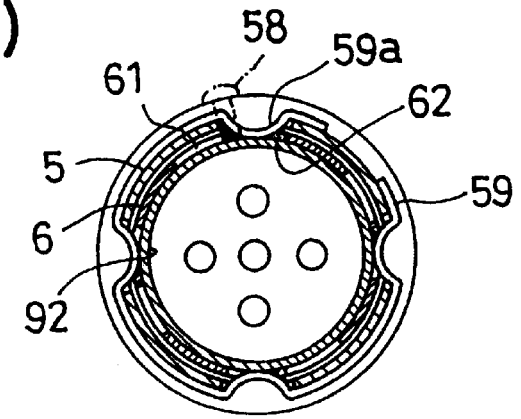
Figure 6:
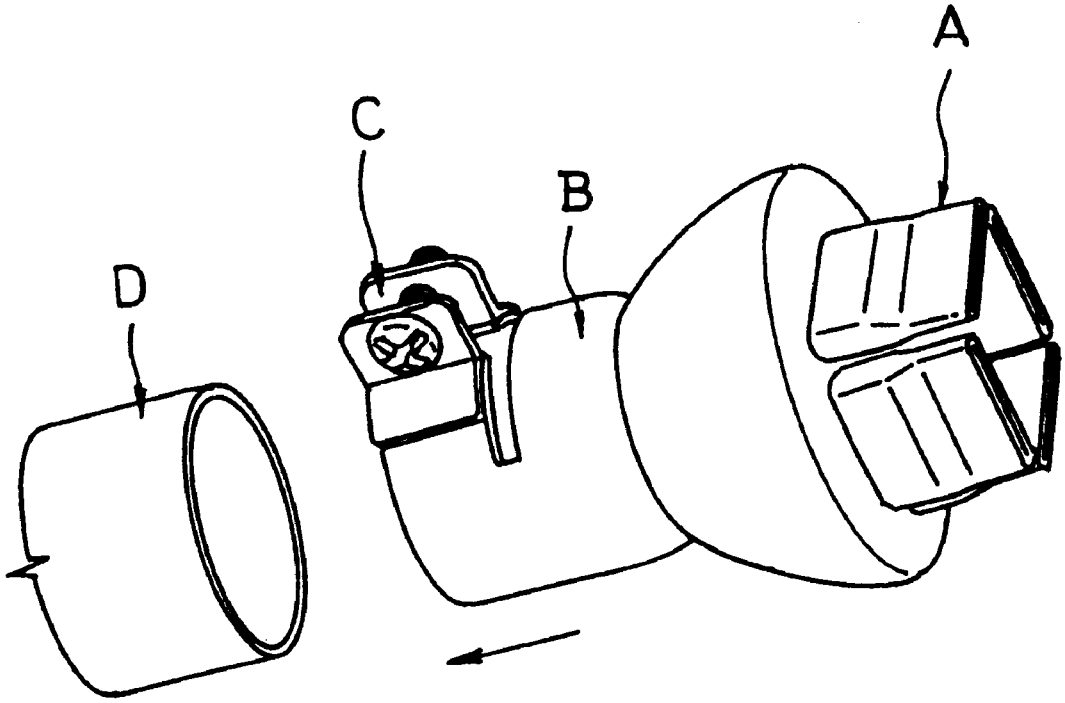
FIG. 6 is a perspective view showing the conventional structure for mounting a hot air nozzle on a nozzle pipe.

The mode of use of the dismountable nozzle 1 in the above embodiment is now described. FIGS. 3~5 show the stages of assembly of the dismountable nozzle 1 in the above embodiment, where (a) is a longitudinal section view and (b) is a transverse section view taken along the line corresponding to the spring groove 52.

First, as illustrated in FIG. 3, the mounting adapter 2 is rigidly secured to the nozzle pipe 92 of the hot air iron 9. For this purpose, the mounting adapter 2 is first passed over the nozzle pipe 92 and the clamping screw 46 is tightened up in such a manner that the clamping members 45 of adapter holder 4 will be closed up to each other. As a result, the upper cylindrical part 42 of the adapter holder 4 tightens the nozzle pipe 92 so that the mounting adapter 2 is positively secured to the nozzle pipe 92. The positioning of the mounting adapter 2 with respect to the nozzle pipe 92 is effected by mounting the nozzle holder 3 on the mounting adapter 2, inserting the nozzle pipe 92, and tightening the clamping screw 46 in the state where the tip of the nozzle pipe 92 is abutted against the bottom wall 63 of the cylindrical member 6. In this manner, the nozzle holder 3 can be attached to the nozzle pipe in air-tight relation with certainty.

Attachment of the nozzle holder 3 to the mounting adapter 2 rigidly secured to the nozzle pipe 92 is now explained. First, as illustrated in FIG. 4, with the engaging bosses 59*a* of the adapter spring 59 being lined up with the recesses 61 of the cylindrical member 6, the cylindrical member 6 is inserted into the lower opening of the adapter cover 5 until the engaging bosses 59*a* are abutted against the lower edges of the recesses 61. The stopper pin 58 is disposed above the engaging boss 59*a* and, therefore, in the condition where the cylindrical member 6 has been inserted into the lower opening of the adapter cover 5, not only the engaging boss 59*a* but also the stopper pin 58 is disposed within the recess 61.

Then, the nozzle holder 3 is rotated clockwise with respect to the mounting adapter 2 whereupon, as illustrated in FIG. 5, the engaging bosses 59*a* of the adapter spring 59 are shifted out from the recesses 61 and brought into engagement with the adjacent slits 62 and, at the same time, the stopper pin 58 is abutted against, and engaged by, the engaging means 61*a* of the recess 61 to preclude further relative rotation. In this connection, since the adapter spring 59 is open in one position and the engaging bosses 59*a* are arcuately formed, the engaging bosses 59*a* are readily deformed radially outward and displaced from the recesses 61 into the slits 62.

In addition, as illustrated in FIG. 5(*b*), it is so arranged that the stopper pin 58 is engaged by the engaging means 61*a* just prior to complete entry of the engaging boss 59*a* into the slit 62. Thus, in the condition where the clockwise end of the engaging boss 59*a* of the adapter spring 59 is abutted against the clockwise end of the slit 62, the stopper pin 58 is engaged by the engaging means 61*a*. Therefore, due to the force urging the cylindrical member 6 of the nozzle holder 3 into rotation which is generated as the engaging boss 59*a* of adapter spring 59 is about to enter into the slit 62 and the counter force acting to arrest said rotation which is generated when the stopper pin 58 is engaged by the engaging means 61*a*, the nozzle holder 3 is secured to the mounting adapter 2 without rattling. For example, the nozzle holder 3 is locked in position under the radial compression by the adapter spring 59. Moreover, since the adapter spring 59 is a wire rod which is rectangular in sectional configuration and each of the engaging bosses 59*a* is a mere projection formed by bending the adapter spring 59 slightly inward in a radial direction, the axial locking of the nozzle holder 3 with respect to the mounting adapter 2 can also be effected with remarkable tightness.

The hot air heater thus carrying the nozzle at its iron segment can be used with advantage chiefly for the mounting and dismounting surface-mounted IC and other parts of printed circuit boards, particularly for the dismounting of IC devices in repair work. Thus, a hot air current heated to about 300~400° C. is delivered from the nozzle element 8 attached to the iron to melt the solder fixing the shanks of IC devices to the substrate board for dismounting the parts. When an elongated suction pipe is provided in the center of the nozzle pipe 92, the dismounting work can be performed while the IC device is aspirated away from the board, thus facilitating the work. For this purpose, it may be so arranged that a central opening is formed in each of the bottom wall 63 of said cylindrical member 6 and the upper and lower end faces 71, 72 of said coupling member 7 and a rotatable dial 93 is disposed at the iron 9. In this arrangement, the suction pipe can be inserted or withdrawn with respect to the nozzle pipe 92 by rotating the dial 93.

On the other hand, the nozzle holder 3 can be disconnected from the mounting adapter 2 secured to the nozzle pipe 92 by rotating the nozzle holder 3 counterclockwise with respect to the mounting adapter 2. as the nozzle holder

3 is thus rotated, the stopper pin 58 is displaced from the engaging means 61*a* to the recess 61 and, at the same time, the engaging bosses 59*a* of said adapter spring 59 are displaced from the slits 62 to the recesses 61 so that the nozzle holder 3 can be easily pulled out from the mounting adapter 2.

What is claimed is:

1. A dismountable hot air nozzle applicable to a hot air jet heater for use in the dismounting of surface-mounted IC devices and other purposes, which comprises a downwardly open cylindrical mounting adapter to be attached to a hot air delivery pipe of said heater, a generally annular adapter spring capable of undergoing elastic deformation in a radial direction and having engaging bosses adapted to project from the inner circumferential wall of said mounting adapter when assembled, a stopper pin disposed adjacently of the engaging boss and projecting radially inwardly of the inner circumferential surface of said mounting adapter, and a nozzle holder having nozzle means for the delivery of hot air from said pipe at its lower end and a cylindrical member engageable with the opening of said mounting adapter at its upper end, the top end of said cylindrical member being formed with recesses through which the engaging bosses of said adapter spring and said stopper pin may pass when the cylindrical member is inserted into said mounting adapter, each of said recesses being formed with an engaging means engageable with said stopper pin at its lateral end in such a manner that when said cylindrical member is inserted into said mounting adapter and rotated in a circumferential direction, said engaging means is engaged by said stopper pin and said engaging bosses are fitted into slits formed adjacent to the recesses of said cylindrical member.

2. A dismountable hot air nozzle according to claim 1 wherein said mounting adapter consists of an adapter holder to be secured to said hot air delivery pipe and an adapter cover disposed at a lower part of said adapter holder, said adapter cover is provided with said adapter spring and stopper pin, said adapter spring is formed with engaging bosses as formed by bending it radially inward in a generally semicircular form in a plurality of circumferential positions, and said adapter cover is peripherally formed with a spring groove in which said adapter spring is disposed, said spring groove being formed with engaging holes passing through the circumferential wall of said adapter cover in positions corresponding to the engaging bosses of said adapter spring.

3. A dismountable hot air nozzle according to claim 2 wherein said stopper pin is disposed above one circumferentially lateral edge of one of said engaging holes of said adapter cover and said engaging means is formed by cutting out the cylindrical member at the other circumferentially lateral edge of the recess of said cylindrical member in such a manner that when said engaging means is engaged by said stopper pin, one circumferentially lateral edge of each engaging boss is abutted against one circumferentially lateral edge of the corresponding slit.

* * * * *